United States Patent [19]

Fockens

[11] Patent Number: 4,846,233

[45] Date of Patent: Jul. 11, 1989

[54] SYSTEM FOR SELECTIVELY EMPTYING OR FILLING A TANK

[75] Inventor: Tallienco W. H. Fockens, Eibergen, Netherlands

[73] Assignee: N.V. Nederlandsche Apparatenfabriek Nedap, De Groenlo, Netherlands

[21] Appl. No.: 149,948

[22] Filed: Jan. 29, 1988

Related U.S. Application Data

[63] Continuation of Ser. No. 869,755, Jun. 2, 1986, abandoned.

[30] Foreign Application Priority Data

Jun. 3, 1985 [NL] Netherlands ..... 8501581

[51] Int. Cl.[4] ..... B67D 5/01; B65B 1/30

[52] U.S. Cl. ..... 141/94; 141/98; 141/83; 141/311 R; 137/804; 340/552; 340/825.34

[58] Field of Search ..... 141/98, 94, 83, 1, 311 R, 141/348, 357, 392; 340/825.3, 825.31, 825.32, 825.34, 505, 552; 137/803, 804, 805

[56] References Cited

U.S. PATENT DOCUMENTS

| | | | |
|---|---|---|---|
| 3,148,713 | 9/1964 | Jones, Jr. | 141/346 |
| 3,642,036 | 2/1972 | Ginsburgh et al. | 141/94 |
| 4,095,214 | 6/1978 | Minasy | 340/552 |
| 4,109,686 | 8/1978 | Phillips | 141/1 |
| 4,263,945 | 4/1981 | Van Ness | 141/98 |
| 4,469,149 | 9/1984 | Walkey et al. | 141/94 |
| 4,544,005 | 10/1985 | Meissner et al. | 141/94 |

FOREIGN PATENT DOCUMENTS

| | | | |
|---|---|---|---|
| 2502134 | 9/1982 | France | 141/94 |
| 1577920 | 10/1980 | United Kingdom . | |

*Primary Examiner*—Henry J. Recla
*Assistant Examiner*—Ernest G. Cusick
*Attorney, Agent, or Firm*—Fleit, Jacobson, Cohn & Price

[57] ABSTRACT

This invention relates to a method and a system for selectively filling or emptying a tank by a filling or discharging device for the tank. In accordance with the invention, a passive responder and an aerial element of an electromagnetic detection system are respectively provided in the vicinity of the inlet or outlet of the tank and on the part of the filling or discharging device cooperating with the tank inlet or outlet. The aerial element forms part of a detection system for generating an electromagnetic interrogation field, which detection system generates a signal when detecting a responder. In one embodiment of the invention, the responder is a passive responder generating a uniquely coded signal by which the detection system identifies the responder.

5 Claims, 2 Drawing Sheets

SYSTEM FOR SELECTIVELY EMPTYING OR FILLING A TANK

BACKGROUND OF THE INVENTION

This application is a continuation, of application Ser. No. 869,755, filed June 2, 1986, now abandoned.

This invention relates to a method and a system for selectively emptying or filling a tank for liquid or bulk material by means of a filling or discharging device for the tank.

Examples of such procedures are filling fuel tanks of vessels, vehicles or aircraft and rail vehicles, transferring chemical products, agricultural products, concrete, products of the petrochemical industry from a storage tank to the tank of a tank-lorry for the transport of such products, and the discharge of such products from the tank-lorry at the customers.

In all these cases there is often a need for an extra check to ensure that the tank is actually filled or emptied by authorized persons, or to ensure that the correct product is loaded into the correct tank or withdrawn from the correct tank.

Thus firms with a large fleet of vehicles, such as haulers, often have their own storage tanks with petrol, diesel oil, auto gas, from which, via a common pump, the vehicles of the fleet can be fuelled. An important point is then that such fuel is indeed only used for automobiles of the firm. A further important point is that each vehicle receives the correct fuel.

SUMMARY OF THE INVENTION

It is an object of the present invention to fill the need outlined above. For this purpose, according to the present invention, a method of the kind described is characterized by the provision of a passive responder in the vicinity of the inlet or outlet of a tank, which responder can be detected by means of an electromagnetic interrogation field, and by the part of the filling or discharging device cooperating with the tank inlet or outlet being provided with at least one aerial element of a detection system for generating the electromagnetic interrogation field, which detection system generates a signal when detecting a responder.

A system according to the present invention for selectively emptying or filling a tank for liquid or bulk material by means of a filling or discharging device for the tank is characterized by an electromagnetic detection system for passive responders, which detection system comprises at least one aerial for generating an interrogation field by means of which the presence of a passive responder associated with the detection system can be detected, said at least one aerial being provided on the part of the filling or discharging device which cooperates with an inlet or outlet of the tank; and by a passive responder provided in the vicinity of the inlet or outlet of each tank to be filled or discharged, said detection system having an output which generates a signal as soon as a responder has been detected. In this system, the interrogative field and aerial element effectively form a transmitter/receiver arrangement. Some embodiments of the invention will now be described, by way of example.

DESCRIPTION OF PREFERRED EMBODIMENTS

Figure 1:
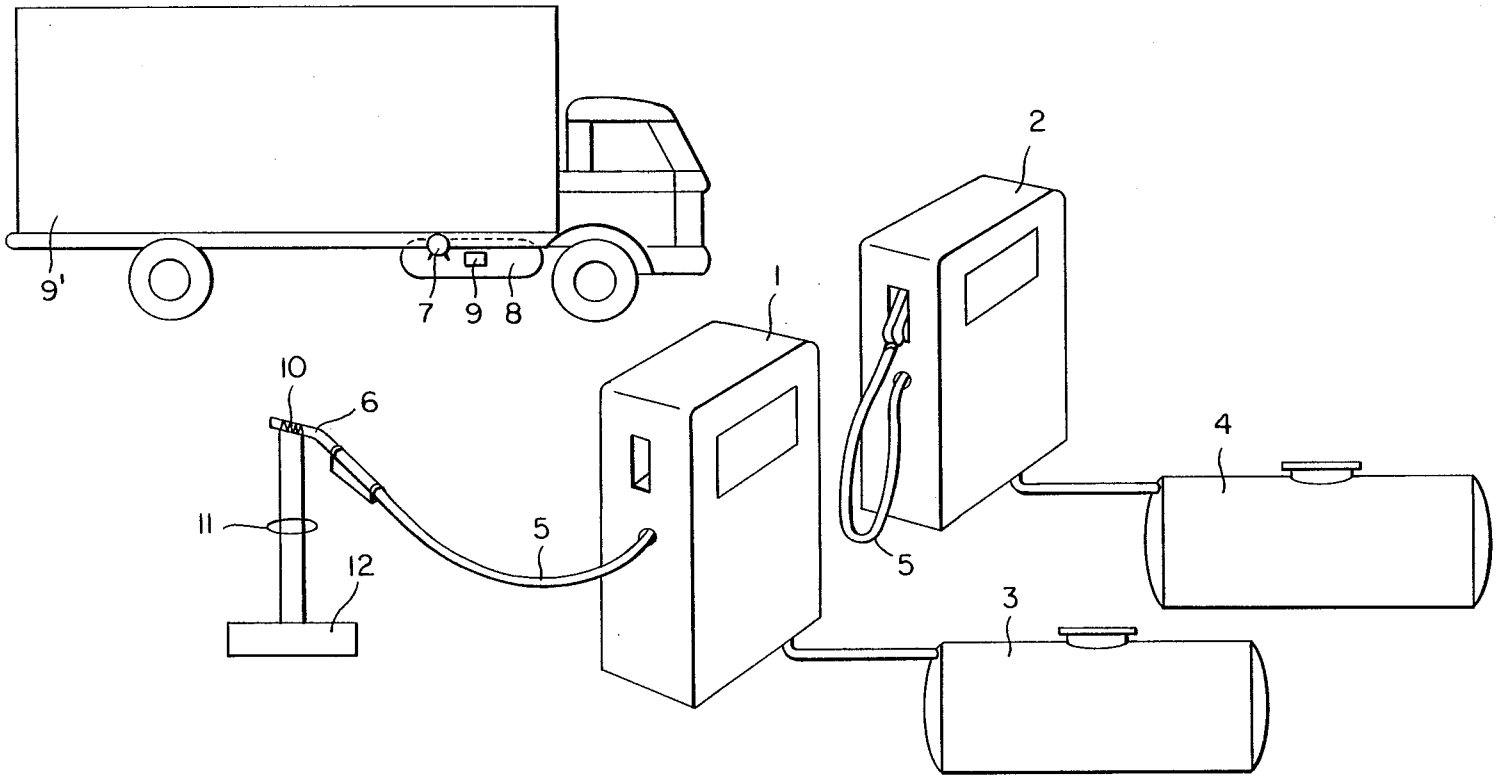
FIG. 1 illustrates diagrammatically an application of the invention in connection with the fuelling of business vehicles and FIG. 2 illustrates an application of the invention in the petrochemical industry.

FIG. 1 diagrammatically shows a fuel station of, for example, a transport firm with a large fleet of vehicles. The fuel station comprises, in this example, two conventional fuel pumps 1 and 2, which are connected to underground fuel storage tanks 3 and 4, respectively. The storage tanks may be filled with the same fuel, for example, diesel oil, or contain different fuels, such as diesel oil and petrol. Each fuel pump is provided, in the usual manner, with a hose 5, with a nozzle 6 formed as a gun-type handle, which can be inserted into the filling hole or inlet 7 of a fuel tank 8 of a lorry 9' belonging to the firm's fleet of vehicles for filling tank 8. Normally, it is left to the lorry driver to select a fuel pump and after the introduction of the hose nozzle into the filling hole of the vehicle tank to fuel the lorry. Although in most cases the amount and kind of fuel taken in by a given vehicle at a given date is recorded in one way or another, errors are possible. If, for example, the fleet comprises vehicles arranged for different kinds of fuel and there are pumps for these different kinds of fuel, a vehicle designed for diesel oil may inadvertently be fueled with petrol.

Another problem is that it could be tried to use the fuel destined for the firm's vehicles for filling the tank of a vehicle not belonging to the firm's fleet.

According to the present invention, these and similar problems can be overcome by using an electromagnetic detection system comprising passive responders. Such detection systems are known per se and are used, for example, for preventing shop lifting, or identifying cattle. A passive responder, in this connection, is a responder which has no source of power, such as a battery of its own. Such responders comprise a tuned resonance circuit which, if the responder is within an interrogation field generated by the system in a given zone, becomes resonant. This disturbs the interrogation field, which can be detected.

In their simplest form, the responders just comprise a resonant circuit, and all responders have the same resonance frequency. In that case, it is only possible to detect the presence of a responder in the interrogation field, but identification of an individual responder is not possible.

In our British Patent No. 1577920, there is described a passive responder which in an interrogation field generates a uniquely coded signal, so that each responder can be distinguished from all the others.

Both types of responder can be used in the present invention. Which type of responder will be used in a given case will depend on the user's requirements.

If, in the example described above and illustrated in FIG. 1, it is only desired to prevent the fuelling of vehicles not belonging to the firm's fleet, it is sufficient to use responders of the simplest form.

In that case, such a responder is provided in the vicinity of the filling hole of the fuel tank of each vehicle of the fleet, as illustrated diagrammatically at 9 in FIG. 1. Furthermore, the nozzle 6 of each hose 5 is provided with at least one aerial 10, by means of which a suitable interrogation field can be generated and the field disturbance caused by a responder can be detected. The aerial preferably takes the form of a coil. The aerial 10 is connected through electrical lines 11 to the electronic section 12 of the detection system. The electronic section supplies the electrical signals required to generate the interrogation field to aerial 10 and further comprises an electrical circuit which is capable of recognizing the disturbance of the interrogation field caused by a responder, and in response thereto can generate an alarm signal or any other signal.

It is noted that the detection system may alternatively be arranged so that aerial 10 only serves to generate the interrogation field and that one or more separate aerials are provided for detecting a field disturbance, which aerials are connected through separate electrical lines to the electronic section 12.

It is further noted that lines 11 preferably extend along hose 5 and that the electronic section 12 may be housed, for example, within the housing of fuel pump 1, or be disposed at some other suitable location.

The detection system may be arranged so that an alarm signal is generated if a fuel pump is actuated while no responder has been detected.

Preferably, however, the detection system is arranged so that, upon the detection of a responder, a signal is generated by the electronic section 12, which enables the fuel pump to be actuated, whereas in the absence of a responder the fuel pump will refuse to be actuated. This gives the additional advantage that, in case nozzle 6 drops out of the filling hole of tank 8, the delivery of fuel is immediately stopped, because responder 9 is then outside the interrogation field.

A refinement of the system described above can be obtained by using interrogation fields of different frequencies, for example, for pumps for different fuels, and to provide the fuel tanks of the various kinds of vehicles with responders responsive to the respective different frequencies. The system may further be so arranged that the operation of the fuel pump is blocked unless a responder has been detected. It can thus be prevented that, for example, the tank of a vehicle designed for diesel oil is fueled with petrol.

A further refinement is possible by providing the fuel tank of each vehicle of the fleet with a responder which in an interrogation field generates a coded signal which uniquely identifies the respective vehicle. On the basis of such a coded signal, it can be prevented in a simple manner that a vehicle is provided with incorrect fuel and furthermore it can be automatically recorded in a simple manner, for example, by means of a computer connected to this system that a certain vehicle has received a certain amount of fuel of a certain kind at a certain date and time. When coded responders are used, errors and fraud are fully excluded, or at any rate, substantially so.

Figure 2:
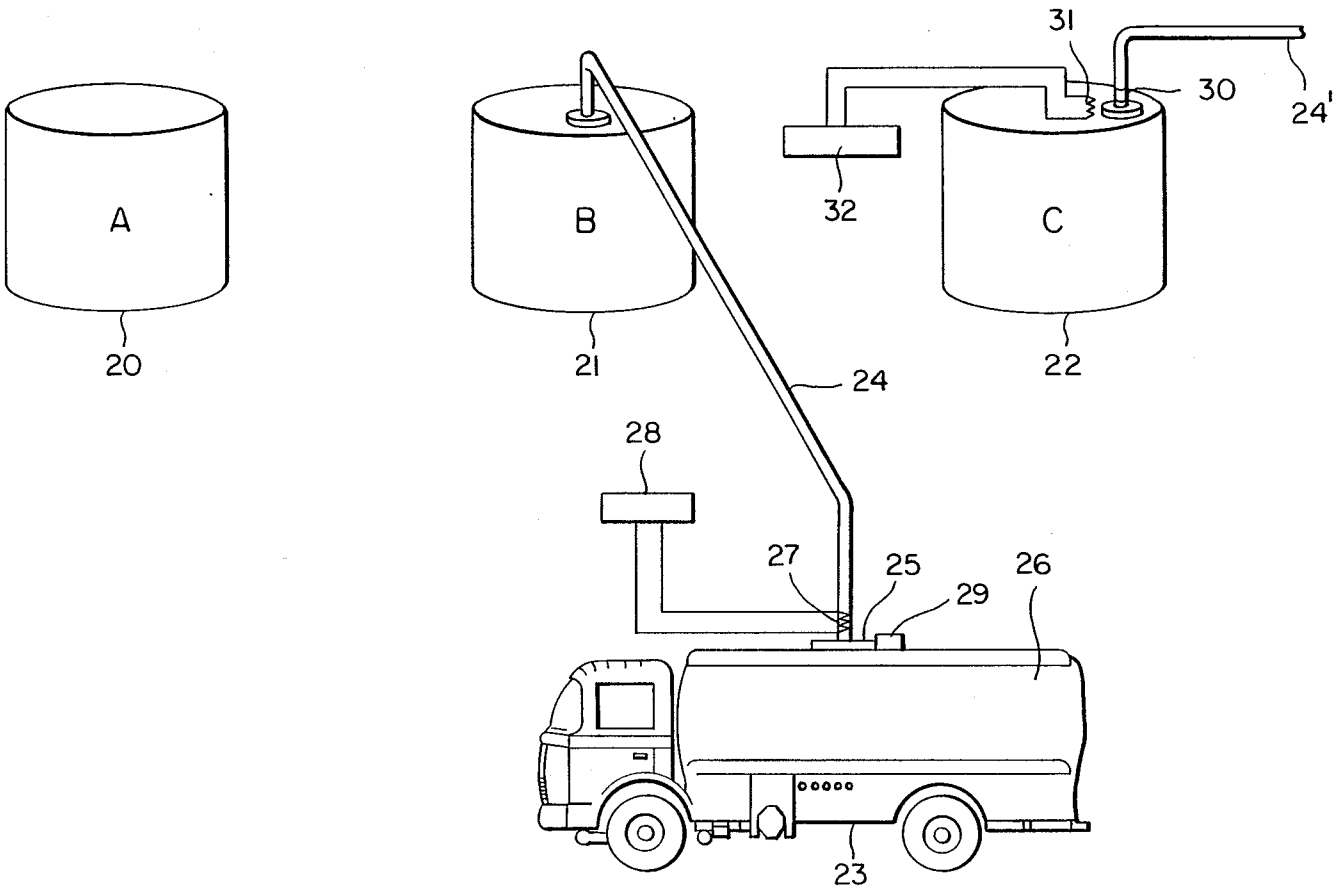

FIG. 2 illustrates an application of the invention in the petrochemical industry, where often different products are handled such as chemicals and different petroleum products contained in different storage tanks, and which have to be transferred into tank-lorries for transportation to customers. A similar situation is to be found in the dairy industry.

FIG. 2 diagrammatically shows three storage tanks 20, 21 and 22, which contain different products A, B and, C which are transported to customers by means of tankers. Such a tanker is shown at 23. The tankers can be filled by means of a conduit 24, the end of which can be introduced into the filling hole 25 of transport tank 26. According to the invention the outlet of conduit 24 is provided with one or more aerials 27, which are connected to the electronic section 28 of a detection system to generate an interrogation field, and capable of receiving a responder signal. Furthermore, within, or in the vicinity of the filling hole of the transport tank, a responder 29 is provided. It is thus ensured that only authorized tank lorries are fueled. When special responders, or coded responders are used for special products, it can further be accomplished that the transport tank of a tank-lorry is only filled with a material for which the transport tank is suitable. Also, when coded responders are used, date, time, customer, quantity and nature of the material can be automatically recorded. In this case too, a pump (not shown) will often be present, which can be controlled on the basis of the responder signal.

If conduit 24 is not fixedly coupled to a storage tank, it is possible to provide the end of the conduit to be coupled to a storage tank with a responder and to provide the tank itself with one or more aerials generating an interrogation field and capable of receiving a responder signal. This is shown diagrammatically at storage tank 22. The responder provided at conduit 24' is shown at 30, and the aerial provided at, or in the vicinity of, the outlet of the storage tank is shown at 31. This aerial is, in turn, connected to an electronic device 32. In this way it can be ensured that the correct conduit is used for the product contained in the storage tank. If conduit 24' belongs to a transport vehicle or a transport vessel, it can also be ensured in this way that the vehicle or vessel is loaded with the correct product. Also, data as to the nature and quantity of the product, identity of the customer and the like can be recorded as described above.

It is observed that the invention can be used in many other situations. Such applications are considered to be within the scope of the present invention.

What I claim:

1. A system for selectively preventing and allowing the filling or emptying a tank for liquid or bulk material by means of a filling or discharging device for the tank, characterized by an electromagnetic detection system for passive responders, which detection system has at least one aerial for generating an electromagnetic interrogation field by means of which the presence of a passive responder having a resonance circuit tuned to the interrogation field can be detected, said at least one aerial being provided on a part of the filling or discharging device cooperating with an inlet or outlet of the tank; and by a passive responder having no source of power and having a resonance circuit tuned to the interrogation field as aforesaid, the responder being provided in the vicinity of the inlet or outlet of each tank to be filled or discharged for disturbing the interrogation field when placed therein, said detection system having means for generating an output when disturbed by a responder.

2. A system as claimed in claim 1, characterized in that each passive responder generates a uniquely coded signal which can be recognized by the detection system and uniquely identifies the responder.

3. A system as claimed in claim 2, characterized in that the output of the detection system is connected to means for actuating or releasing the filling or discharging device, and to automatic recording means.

4. A system as claimed in claim 1, characterized in that the output of the detection system is connected to means for actuating or releasing the filling or discharging device.

5. A system for selectively preventing and allowing the filling or emptying a tank for liquid or bulk material by means of a filling or discharging device for the tank, characterized by an electromagnetic detection system for passive responders of the type having a resonance circuit and no source of power, which detection system has at least one aerial for generating an electromagnetic interrogation field by means of which the presence of a passive responder having a resonance circuit tuned to the interrogation field can be detected; said at least one aerial being provided in the vicinity of the inlet or outlet of the tank; and the system including a passive responder having a resonance circuit tuned to the interrogation field as aforesaid, the responder being provided on a part of the filling or discharging device cooperating with the inlet or outlet of the tank for disturbing the interrogation field when placed therein, said detection system having means for generating an output signal when disturbed by the responder.

* * * * *